US009177496B2

(12) United States Patent
John

(10) Patent No.: US 9,177,496 B2
(45) Date of Patent: Nov. 3, 2015

(54) MATRIX ADDRESSED DISPLAY SYSTEM

(75) Inventor: Bernd John, Billericay (GB)

(73) Assignee: Visteon Global Technologies, Inc., Van Buren Township, MI (US)

( * ) Notice: Subject to any disclaimer, the term of this patent is extended or adjusted under 35 U.S.C. 154(b) by 272 days.

(21) Appl. No.: 13/167,592

(22) Filed: Jun. 23, 2011

(65) Prior Publication Data

US 2011/0316765 A1 Dec. 29, 2011

(30) Foreign Application Priority Data

Jun. 25, 2010 (GB) ..... 1010721.7

(51) Int. Cl.
*G09G 3/30* (2006.01)
*G09G 3/00* (2006.01)

(52) U.S. Cl.
CPC ..... *G09G 3/006* (2013.01); *G09G 2330/08* (2013.01); *G09G 2330/12* (2013.01)

(58) Field of Classification Search
None
See application file for complete search history.

(56) References Cited

U.S. PATENT DOCUMENTS

| | | | | |
|---|---|---|---|---|
| 6,529,190 | B2 * | 3/2003 | Jiang et al. | 345/211 |
| 7,647,529 | B2 * | 1/2010 | An | 714/43 |
| 7,869,915 | B2 * | 1/2011 | Katrak et al. | 701/32.8 |
| 2002/0054281 | A1 * | 5/2002 | Yamada | 355/53 |
| 2005/0156810 | A1 | 7/2005 | Zerphy et al. | |
| 2011/0084891 | A1 * | 4/2011 | Ozaki | 345/1.1 |
| 2011/0096079 | A1 * | 4/2011 | Carter | 345/520 |

FOREIGN PATENT DOCUMENTS

| | | | |
|---|---|---|---|
| DE | 10 2004 032 807 | A1 | 2/2006 |
| DE | 10 2005 023 818 | A1 | 11/2006 |
| EP | 1 796 382 | A2 | 6/2007 |
| JP | 2009248935 | A * | 10/2009 |
| WO | WO2009/020997 | | 2/2009 |

OTHER PUBLICATIONS

Intellectual Property Office of the United Kingdom; Combined Search and Examination Report for Patent Application No. GB1010721.7 filed Jun. 25, 2010; (Date of Report: Oct. 11, 2010).
Office Action dated Sep. 9, 2013 from corresponding German application.

* cited by examiner

*Primary Examiner* — Nicholas Lee
*Assistant Examiner* — Duane N Taylor, Jr.
(74) *Attorney, Agent, or Firm* — Klintworth & Rozenblat IP LLC

(57) ABSTRACT

The present invention relates to the monitoring and correction of display errors in a matrix addressed display system. The display system comprises a graphics system, a display module and a display fault handling system including a memory. The display module has a matrix addressed electro-optical array of display elements, the display elements being arranged in rows and columns and having corresponding row and column circuit lines. The graphics system generates display data and sends this to the display module in order to activate using row and column circuit lines each of the display elements and thereby display visual information to a user of the system based on the display data. The display fault handling system is used to monitor over a period of time at least one electrical parameter of a plurality these circuit lines and determine whether or not a display error has occurred.

21 Claims, 3 Drawing Sheets

MATRIX ADDRESSED DISPLAY SYSTEM

CROSS-REFERENCES TO RELATED APPLICATIONS

The Present Application claims the benefit of United Kingdom Patent Application No. GB1010721.7 entitled "MATRIX ADDRESSED DISPLAY SYSTEM" and filed on 25 Jun. 2010, the content of which is hereby incorporated herein by reference in its entirety to the extent permitted by law.

FIELD OF THE INVENTION

The present invention relates to the monitoring and correction of display errors in a matrix addressed display system.

BACKGROUND OF THE INVENTION

Matrix addressed display systems are increasingly common in many applications, and in particular in the field of automotive display systems. As automotive matrix addressed displays become increasingly used to display a wide range of vehicle operating parameters, it become more important that any display errors are promptly detected and, if possible, corrected, while causing minimal disruption of the information provided to the driver. However, the increasing sophistication of display systems makes this harder to achieve, as the source of the error may be in any of several layers of display hardware, including a host computer system, a graphics system for the display or the display module itself including power supplies, display driver electronics and the electro-optical components of the display area.

It is therefore an object of the invention to provide a more convenient and efficient system for the monitoring and correction of display errors in a matrix addressed display system.

SUMMARY OF THE INVENTION

The present invention is defined by the following claims, and nothing in this section should be taken as a limitation on those claims.

According to a first aspect of the invention, there is provided a matrix addressed display system, comprising a graphics system for generating display data, a display module for displaying visual information to a user of the system based on said display data and a display fault handling system for the detection and correction of display errors by the display module, the graphics system having a data output and the display module having a data input, said display data being provided by the graphics system to the display module from the data output to the data input, and the display module having a matrix addressed electro-optical array of display elements for displaying said visual information, the display elements being arranged in rows and columns and having corresponding row and column circuit lines for selectively activating each of said display elements, and the display fault handling system comprising a display error detection means for detection of display errors and a display error correction means for the correction of said display errors, the display error correction means being connected by means of a first connection to the display module and being connected by means of a second connection to the graphic system, wherein:

a. the display error detection means is connected to a plurality of said circuit lines and, in use, is arranged to monitor over a period of time at least one electrical parameter of each of said connected circuit lines and to determine therefrom whether or not a display error has occurred at one or more of said activated display elements;

b. the display error correction means includes a memory and a processing means, the processing means being connected to the display error detection means and, in use, receives and stores in said memory data relating to said detected display errors over said period of time;

c. the processing means, in use, is responsive to said data to send at least one reset command over the first connection to reset the operation of the display module in an initial attempt to correct said detected display errors, and if the initial attempt is unsuccessful, then to send at least one reset command over the second connection to reset the operation of the graphics system in a subsequent attempt to correct said detected display errors.

In a preferred embodiment of the invention, the graphics system comprises a graphics unit that provides the data output, and a graphics control system that controls the operation of the graphics unit and which provides data signal representing the information to be displayed. The operation of the graphics system may then be reset either by resetting the graphics unit or by resetting the operation of the graphics control system or by resetting both the graphics unit and the graphics control system.

The graphics control system may be provided by an application that generates the display information, for example a satellite navigation system, or may be part of a more general host system, for example an operating system running in a microprocessor.

A particular advantage of the invention is that a display module will normally take considerably less time to reset than a graphics system, owing to the greater electrical and software complexity of a typical display module as compared with a graphics system. As detected display error could be due either to a problem with the display module or the graphics system, the invention provides a more efficient and convenient way of dealing with a display fault, in particular because the user of the system is much less likely to notice any interruption in the display when the initial reset command is sent to reset the operation of the display module, which may be a barely perceptible flash of a display screen, than when the subsequent reset command is sent to reset the operation of the graphics system, which can in practice take many seconds to accomplish.

The processing means may be any suitable digital and/or analogue circuitry for processing the data received from the display error detection means and retrieved from the memory. This may be a dedicated microprocessor or may be implemented in a microprocessor that also controls other aspects of the display system operation. The processing means may also be used to implement functions of the display error detection means.

The first connection may be either a physical or a logical connection, for example a data bus for carrying multiple signals in parallel or may be a data line carrying serial data, or can be any other type of connection for communicating the initial reset command. Similarly, the second connection may be either a physical or a logical connection, for example a data bus for carrying multiple signals in parallel or may be a data line carrying serial data, or can be any other type of connection for communicating the subsequent reset command.

The stored data may include information on the type of error that has been detected. Alternatively or additionally, the stored data may include information relating to the physical location of the error in the display system.

The type of electrical parameter that is monitored will depend on the type of matrix display, and the nature of any error detection circuitry that may be integrated on the display area together with active matrix display driver circuitry. The display module may provide a series of diagnostic feedback pulses, synchronized with the activation of the display elements. Examples of electrical parameters that may be measured would then include pulse width, pulse timing, or maximum pulse voltage. Such a diagnostic signal can then be compared by the display error detection means with a display synchronization signal received directly from the graphics system.

In a preferred embodiment of the invention, the display module is powered by at least one power supply, which may be at least one dedicated power supply not used for any other systems, and the initial reset command when received by the display module acts to power down and power up the power provided to the display module from the, or each, power supply. A display module will normally take less time than a graphics system to power down and power up.

The graphics system may be powered by at least one power supply, in which case the subsequent reset command when received by the graphics system acts to power down and power up the power to the graphics system from the, or each, power supply.

The reset signals may, however be used to reset operating functions of the graphics system or the display module, rather than simply powering these off and then back on.

For example, the display module may comprise a signal processor. The initial reset command when received by the display module may then act to reset this signal processor.

The display module may also comprise a timing controller that is, for example, used to synchronize the data received from the graphics system with sequential addressing of each circuit line. In this case the initial reset command when received by the display module acts to reset the timing controller. Such a reset can be very rapid.

In a preferred embodiment of the invention, the display fault handling system keeps an error count related to the number of detected display faults and compares said count to an upper limit threshold, the initial reset command only being sent to the display module if said count is below the upper limit threshold.

Also in a preferred embodiment of the invention, the display fault handling system keeps an error count related to the number of detected display faults and compares said count to an upper limit threshold, the subsequent reset command only being sent to the graphics system if said count is below the upper limit threshold.

In both cases, the use of an upper limit threshold is useful because if the count exceeds the threshold, then this can be an indication of a persistent display fault. In such cases it is highly unlikely that any further action by the display fault handling system will clear the display error. Therefore, it can be better to take no action which might adversely affect information displayed to a user during resetting of the display module or the graphics system.

The display fault handling system may have a data input, with the data output of the graphics system being connected to this data input. The display data may then be provided by the graphics system to the display fault handling system so that the display fault handling system can use this display data together with the monitored electrical parameter(s) in the determination by the processing means of whether or not a display error has occurred.

The display data preferably includes a display synchronization signal. The display module may include feedback circuit elements integrated with said display elements, in which case the synchronization signal may be used by the feedback circuit elements to generate a periodic feedback signal synchronized with the display synchronization signal.

According to a second aspect of the invention there is provided a motor vehicle, comprising a matrix addressed display system, said system being according to the first aspect of the invention; and a vehicle power on/off control for activating and deactivating the motor vehicle; wherein the display fault handling system, in use, is responsive to send said initial reset command or said subsequent reset command only for the first occurrence of a display error following an activation of the motor vehicle.

The display fault handling system of the motor vehicle preferably keeps an error count related to the number of detected display faults when the vehicle is activated. This count may then be retained after the vehicle has been deactivated for use following a subsequent activation of the motor vehicle. The display fault handling system then reduces this count towards zero whenever there is no detected display fault between one cycle of vehicle activation and deactivation.

Also according to the invention there is provided a method of detecting and correcting display errors of a display module in a matrix addressed display system, the system comprising a graphics system, a display module and a display fault handling system including a memory, the display module having a matrix addressed electro-optical array of display elements, the display elements being arranged in rows and columns and having corresponding row and column circuit lines, the method comprises the steps of:

a. using the graphics system to generate display data;
b. sending the display data from the graphic system to the display module;
c. using the row and column circuit lines to selectively activate each of the display elements and thereby display visual information to a user of the system based on said display data; and
d. using the display fault handling system to:
   i. monitor over a period of time at least one electrical parameter of a plurality said circuit lines;
   ii. determine from said monitored parameter(s) whether or not a display error has occurred at one or more of said activated display elements;
   iii. store in the memory data relating to at least one detected error over a first portion of said period of time;
   iv. use said stored data in a first decision to send an initial reset command over a first connection to reset the operation of the display module in a first attempt to correct said detected display errors;
   v. store in the memory further data relating to at least one detected error over a second portion of said period of time subsequent to said first portion; and
   vi. use said stored data in a second decision to send a subsequent reset command over a second connection to reset the operation of the graphics system in a second attempt to correct said detected display errors when said first attempt is unsuccessful.

The error data may relates to a plurality of persistent detected errors in at least one activated display element, and said first decision involves a determination as to whether or not there is a persistent display error and said second decision involves a determination as to whether or not there is a persistent display error.

Data relating to a plurality of detected errors over said first portion of said period of time may then be used in the first decision, and data relating to a plurality of detected errors over the second portion of said period of time may be used in the second decision.

The display data may include a display synchronization signal, the display fault handling system receiving from the graphics system the display synchronization signal and using this synchronization signal in the determination of whether or not a display error has occurred.

The initial reset command when received by the display module may act to power down and power up the display module. Similarly, the subsequent reset command when received by the display module may act to power down and power up the graphics system.

BRIEF DESCRIPTION OF THE DRAWINGS

The invention can be better understood with reference to the following drawings and description. The components in the figures are not necessarily to scale, emphasis instead being placed upon illustrating the principles of the invention.

The invention will now be further described, by way of example only, and with reference to the accompanying drawings, in which.

DETAILED DESCRIPTION

Figure 1:
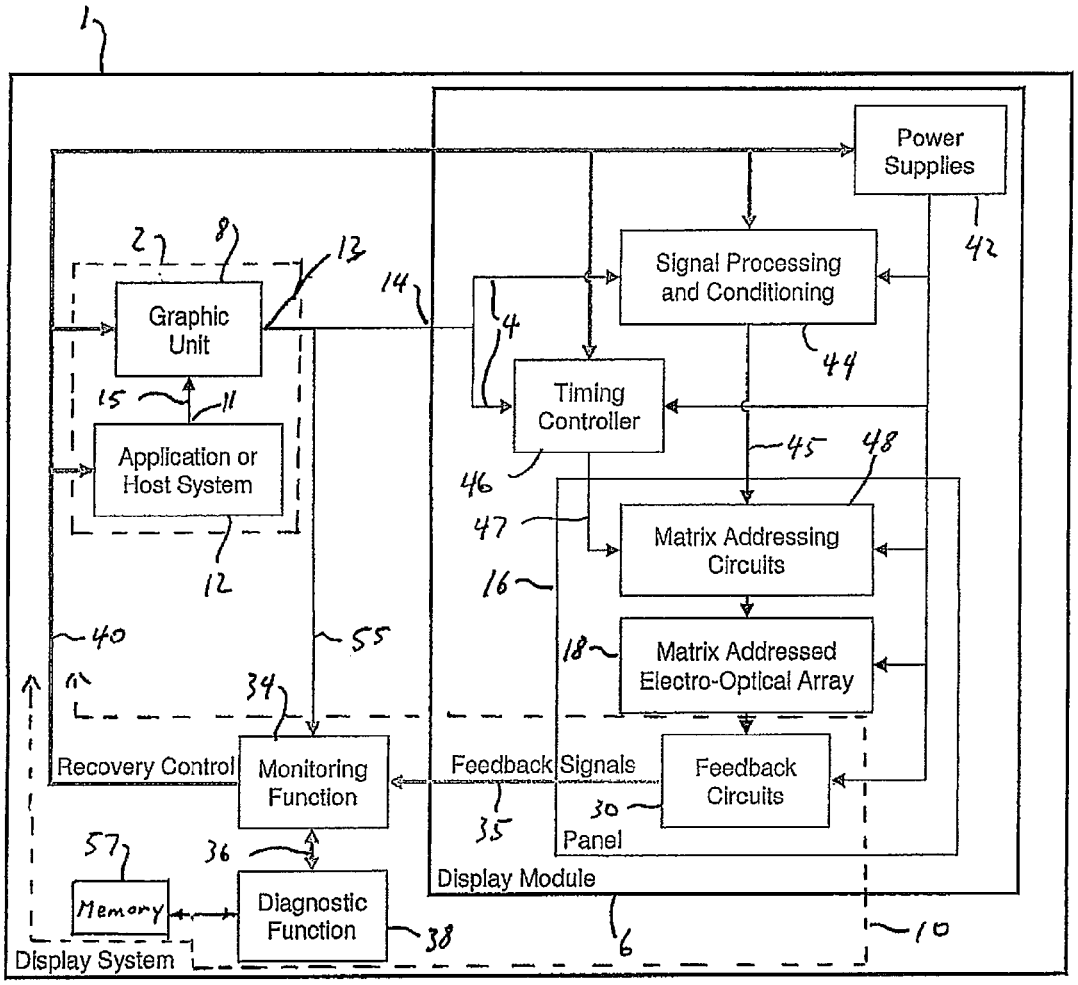
FIG. 1 is a block schematic diagram of a matrix addressed display system according to a preferred embodiment of the invention, showing a display module, a graphics system, and a display fault handling system including a the display error detection means and a the display error correction means.

FIG. 1 shows a matrix addressed display system 1, comprising a graphics system 2 for generating display data 4, a display module 6 for displaying visual information to a user of the system from the display data and a display fault handling system 10 for the detection and correction of display errors by the display module.

The graphics system 2 includes a graphics unit 8 and a display control system 12, which may be an application system (such as a satellite navigation system) or a computer host system. The display control system that has an output 11 that provides data and command signals 15 to control the operation of the graphics unit 8. The graphics unit 8 has a data output 13 and the display module has a data input 14, the display data 4 being provided by the graphics unit 8 to the display module 6 from the data output 13 to the data input 14. The display module 6 has a display panel 16 that includes, as shown in FIG. 2, a matrix addressed electro-optical array 18 of red, green and blue display elements 21, 22, 23 for displaying the visual information to the user.

The display elements 21, 22, 23 are arranged in rows 24 and columns 26 and have corresponding row and column circuit lines 25, 27 for selectively activating each of the display elements.

Figure 2:
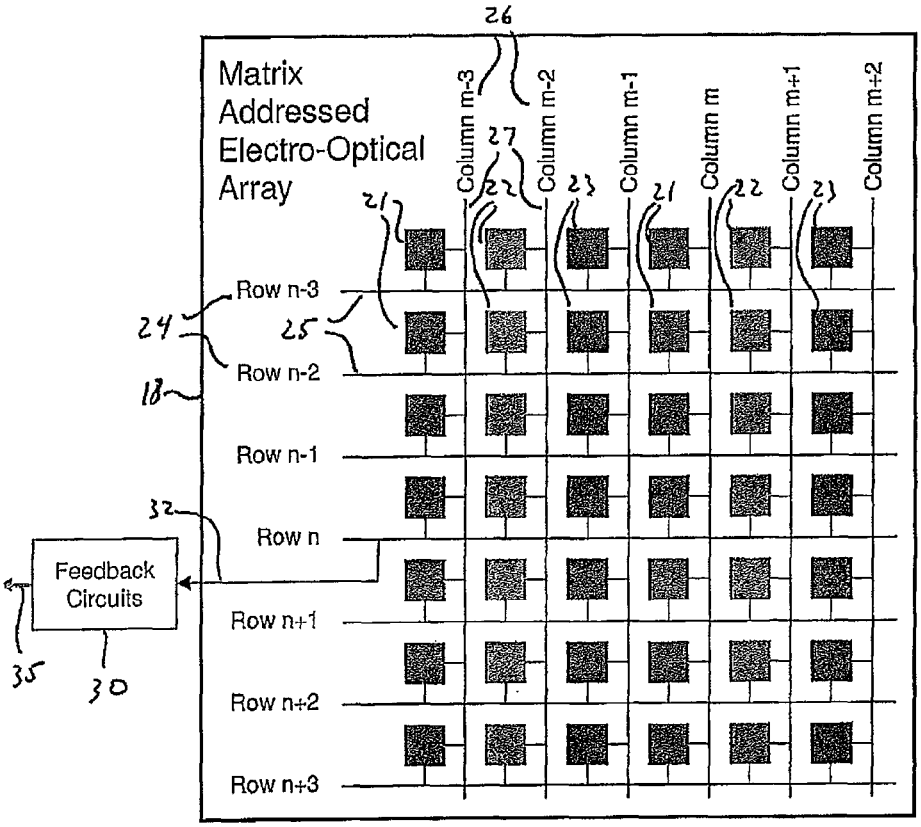
FIG. 2 is a simplified schematic diagram of part of a matrix addressed electro optical display with a number of feedback circuits that each provide a feedback signal for use in a monitoring function of the display error detection means.

The display fault handling system 10 comprises a plurality of feedback circuits 30, just one of which is shown in FIG. 2, a display error monitoring function 34, a display error diagnostic function 38 and a memory 57. The feedback circuits 30 may be integrated with circuit traces on the display array 18. In this example, each row circuit line 25 is connected 32 to one feedback circuit 30 and provides a display error feedback signal 35 to the error monitoring function 34. Although not illustrated, it may, however, either alternatively or additionally be possible to connect a plurality of the column circuit lines 27 to appropriate feedback circuits 30 to provide display error feedback signals from the display element columns to the error monitoring function 34.

The display data 4 will in general include at least one display synchronization signal, in which case the synchronization signal may be used by the display fault handling system 10 in the determination of whether or not a display error has occurred. The display synchronization signal may be used by the feedback circuit 30 to generate a periodic feedback signal synchronized with the display synchronization signal.

The display error monitoring function 34 is connected by a bi-directional data link 36 to the display error diagnostic function 38. The error monitoring function passes data to the error diagnostic function which then analyses the data to determine when a display fault may have occurred.

The display fault handling system 10 also comprises a recovery control output 40, provided by the monitoring function. The recovery control output will most conveniently be provided on a data bus, which is linked to the graphic unit 8, the application or host system 12, and functional units associated with the operation of the display module 6, for example one or more power supplies 42, and signal processing and conditioning circuitry 44 and a timing controller 46. When a fault is detected by the monitoring function 34 and diagnostic function 38, the monitoring function can then send a reset command over the recovery control output 40 to reset the operation of one or more of these components. When the output is a data bus, the reset command is carrier by a logical connection to the component being reset.

In this example, the display data 4 contains both timing information and display element activation data. The display data 4 is therefore provided to both the timing controller 46 and the signal processing and conditioning circuitry, each of which provides a respective control output 45, 47 to the matrix addressing circuits 48. The matrix addressing circuits in turn have outputs that are connected to each one of the row and column circuit lines 25, 27, so that the display elements are each activated to the correct degree and at the correct times according to the received display data 4.

When one or more display elements along a row are to be activated, a drive voltage is applied to each corresponding column, and at the same time a voltage or current pulse is applied to the row in order to activate the selected elements. In many displays, the intensity of each of the display elements is controlled by the level of the column drive voltage.

The row and column drive signals may be weak and so these will usually need to be buffered by the feedback circuits 30. The column drive and row pulse voltages are, for many types of display, both positive and negative signals. The feedback circuit output may provide a signal that is negative and positive going or may be only positive or negative, but in any case must be able to convey to the monitoring function of the display error detection means any abnormalities in the signal levels present on each row or column that would indicate an error with the operation of one or more of the activated display elements.

Figure 3:
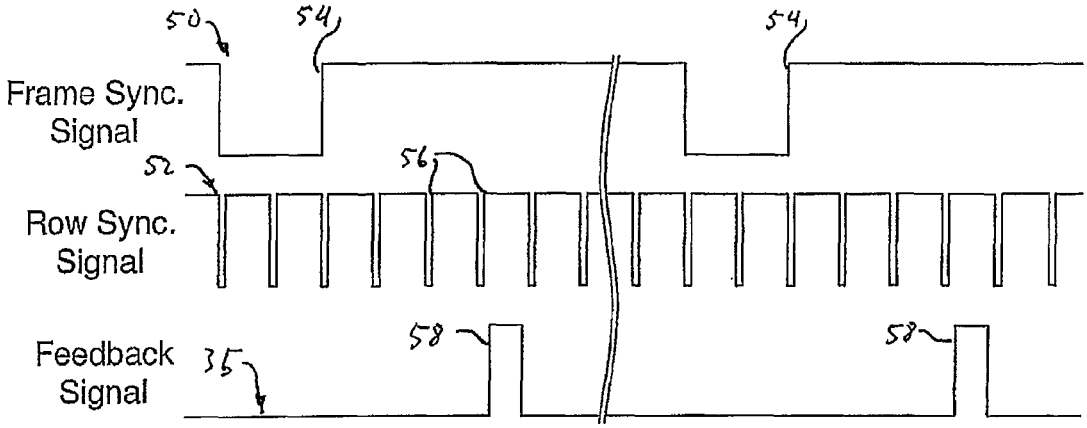
FIG. 3 is a schematic diagram showing how one of the feedback signals can be correlated with timing synchronization signals used to drive row and column circuit lines at correct times.

FIG. 3 is a schematic diagram showing how one of the feedback signals can be correlated with the timing synchronization signals used to drive the row and column circuit lines 25, 27 at the correct times. A regular frame synchronization signal 50 comprises a series of negative going pulses 54 each of which signals the start of a new cycle in which all display rows and columns are addressed to create an image on the display screen.

A row synchronization signal 52 comprises a series of negative going pulses 56, one of each row of the display and which are is synchronized with the frame synchronization signal so that each pulse refreshes the display elements for one row of the display. Not shown, are column activation signals which are refreshed between the row activation pulsed 56 and which determine the degree of activation of each display element.

The row synchronization pulses will not be perfectly square, and will have a shape that is dependent in a number of factors, such as the number of correctly operating display elements on each row. In this example, the feedback circuits 30 detects at least one electrical parameter on a row circuit line 25 which is indicative of correct or incorrect operation of the activated display elements when the row synchronization pulse is applied. Examples include voltage rise and fall times, pulse width and pulse height.

The feedback circuits 30 then each provide a single positive going pulse 58 once after each frame synchronization signal pulse 54 when the expected voltage signal has been present on the row circuit lines 25. Because each row 25 is activated sequentially, the monitoring function 34 therefore receives a series of such pulses 58, separated in time, from each of the feedback circuits 30. In an abnormal operating condition, one or more of the feedback signal pulses 58 will be absent or distorted.

The feedback circuits 30, monitoring function 34 and diagnostic function 38, therefore function as a display error detection means during the detection of display errors. Once an error has been detected, the diagnostic function 38, monitoring function 34 and recovery control output 40 function as a display error correction means for correcting these display errors by resetting one or more of the display system components over the data bus 40, which provides a logical first connection to the display module 6 and a logical second connection to the graphics system 2.

Figure 4:
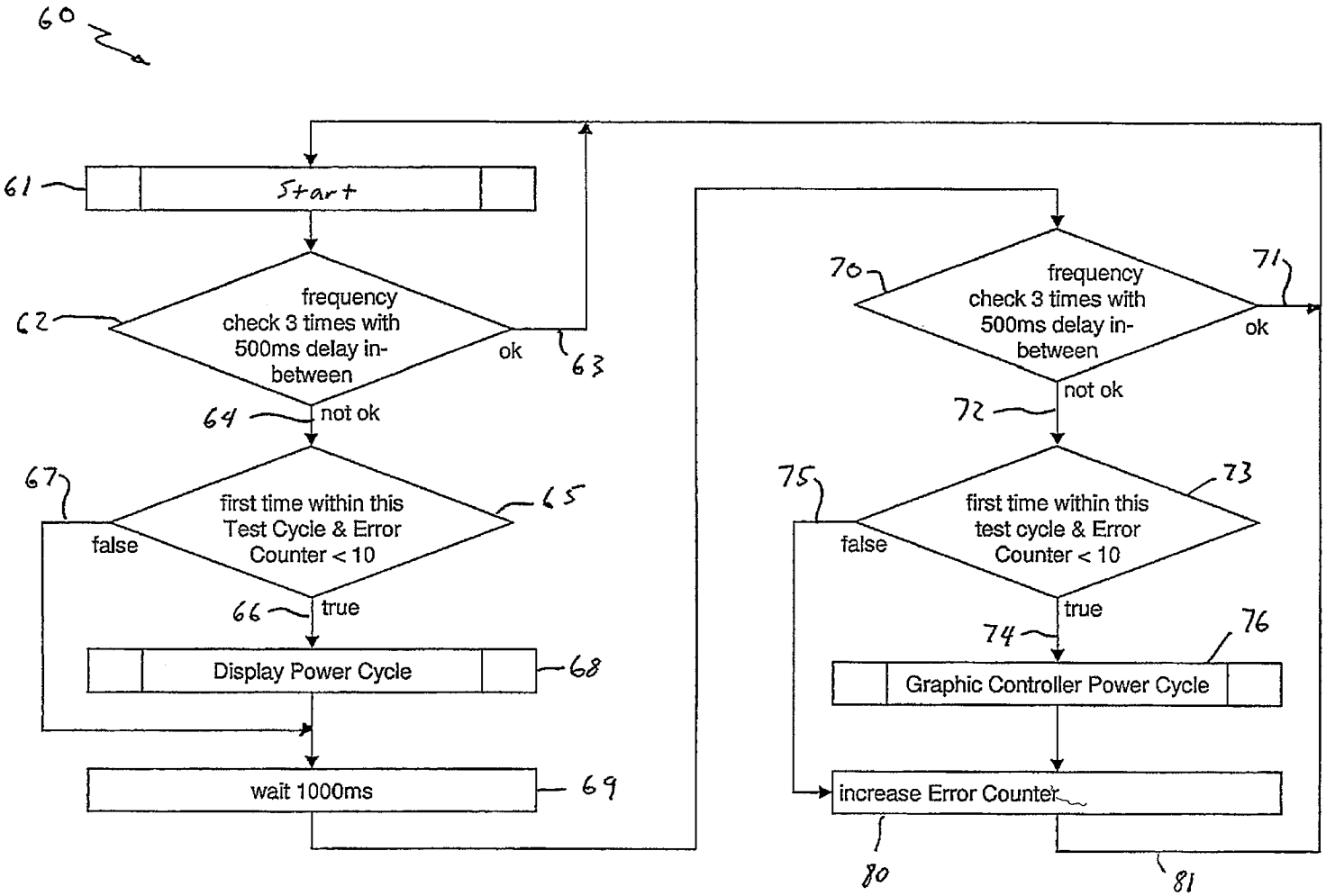
FIG. 4 is a flowchart illustrating a method of detecting and correcting display errors of a display module in a matrix addressed display system, according to a preferred embodiment of the invention.

FIG. 4 shows a process flowchart 60 that illustrates the method of the invention in more detail. The process starts at block 61. The display error detection means 30, 34, 38 monitors over a period of time at least one electrical parameter 35, 58 of each of the connected circuit lines 25. In this example, a first error test 62 is performed over a first portion of said period of time in which the frequency of the feedback signal pulses 58 is checked three times with a delay of 500 ms between each test. The results of these three tests are stored in the memory 57 and if the measured frequency is the expected frequency, then the process returns 63 to the start 61 point.

The expected frequency may be a predetermined value or may alternatively be determined from a timing signal 55 received by the display fault system 10 from the graphics system 2.

If the measured frequency is not the expected frequency 64, then the diagnostic function 38, which in general will be performed by a processing means such as a microprocessor, performs a first persistent error check 65. The check has two parts the first of which is to check if this is the first time within a test cycle that this first error test 62 has been performed and failed 64. When the system is implemented in a motor vehicle, a test cycle is defined as the time period between key-on and key-off, i.e. the time when the motor vehicle display system is energized. This check involves recalling from the memory 57 a first time error flag specific to this failure 64, which will be False if the first error test 62 has previously been failed and True if this is the first time the first error test 62 has been failed. The first time error flag is reset to True every test cycle. Therefore, the diagnostic function 38 stores in the memory 57 data relating to previously detected display errors over the test cycle.

The second part of the first persistent error check 65 is to see if an error counter value stored in the memory 57 is less than ten. The error counter value is initially set to zero in the memory 57 at the start of the very first test cycle. The error counter value is always incremented 80 by one when the display fault handling system 10 is unsuccessful in correcting a display system error and this count value is also saved between test cycles. The error counter value is decreased by one for each test cycle in which there is no detected error, down to a minimum value of zero. Therefore, the diagnostic function 38 also stores in the memory 57 data relating to previously detected display errors over multiple test cycles.

When the error counter value reaches ten, this is indicative of a persistent error in multiple test cycles which cannot be corrected. In such a circumstance, it is quite unlikely that it will be possible to correct the error by sending any reset commands.

Therefore, if the two-part persistent error check 65 determines that the first time error flag is False, or that the error count is ten or more, then no reset commands will be sent to any display system components.

However, if both tests are passed 66, then the display fault handling system makes a first attempt to correct the fault by sending a reset command 68 to the display system 6 over the data bus 40. This reset signal may be to the signal processing and conditioning unit 44 or the timing controller 46, but is preferably to one or more of the power supplies 42, causing a display power cycle 68 in which the power is momentarily cut to the signal processing and conditioning unit 44 and/or the timing controller 46, as well as to the display panel 16 including associated circuitry such as the matrix addressing circuits 48. Such a power cycle can clear certain types of electrical or software faults, and will typically take less than one second to accomplish. During this time, the display screen 18 may momentarily go blank, but often a driver of a motor vehicle, who will be concentrating on the road and driving the vehicle, will not even notice this. Following this, the process waits for one second 69 to give the display system time to settle down.

On the other hand, if either of the tests is failed 67, then the fault is likely to be a persistent fault, in which case sending the reset command to the display module is very unlikely to have any beneficial effect. Therefore, the process skips the display unit power cycle 68, and then waits for one second 69.

The display error detection means 30, 34, 38 then checks 70 over a second portion of said period of time the frequency of the feedback signal pulses 58 three times again, with a delay of 500 ms between each test. The results of these three tests are stored in the memory 57 and if the measured frequency is the expected frequency, then the process returns 71 to the start of the process. In this case, the error initially detected at the first error test 62 has either been corrected by the reset command 68 or (in the case the reset command was skipped) the error has not reappeared, in which case the error is not persistent. Therefore, when the process returns 71 at this point to the start, the error counter 80 is not increased.

If the measured frequency is not the expected frequency 72, then there is a persistent error, either because the error initially detected at the first error test 62 has not been corrected by the first reset command 68, or (in the case that the reset command was skipped) because the error has reappeared. Therefore, before the process returns 81 to the start, the error counter 80 will be increased by one.

The diagnostic function 38 first performs a second persistent error check 73 which, as explained above, will in general be performed by a processing means such as a microprocessor. The second persistent error check 73 takes the same form as the first persistent error check 65, having two parts the first of which is to check if this is the first time within a test cycle that the second error test 70 has been performed and failed 72. When the system is implemented in a motor vehicle, a test cycle is defined as the time period between key-on and key-off, i.e. the time when the motor vehicle display system is energized. This check involves recalling from a memory 57 a first time error flag specific to this failure 72, which will be False if the second error test 70 has previously been failed and True if this is the first time the second error test 70 has been failed. The first time error flag is reset to True every test cycle. Therefore, the diagnostic function 38 stores in the memory 57 data relating to previously detected display errors over the test cycle.

The second part of the persistent error check 65 is to see if an error counter value stored in the memory 57 is less than ten. The error counter value is the same as that described above.

When the error counter value reaches ten, this is indicative of a persistent error in multiple test cycles which cannot be corrected. In such a circumstance, it is quite unlikely that it will be possible to correct the error by sending any reset commands.

Therefore, if the two-part persistent error check 73 determines that the first time error flag is False, or that the error count is ten or more, then no reset commands will be sent to any display system components.

However, if both tests are passed 74, then the display fault handling system makes a second attempt to correct the fault by sending a second reset command 76 to the graphics system 2 over the data bus 40. This reset signal may be to the application or host system 12, but is preferably to the graphics unit 8. In this example, the reset command causes a graphics unit power cycle 76 in which the power is momentarily cut to the graphics unit, but not the host or application system 12. Such a power cycle can clear certain types of electrical or software faults, and will typically take more than one second and less than five seconds to accomplish. During this time, the display screen 18 may freeze or go blank. Because of the length of time involved in such a reset, a driver of a motor vehicle is more likely to notice such a reset than a reset of the display module 6.

Optionally, the method may involve a third stage of resetting (not illustrated) of the same form as that described above, in which the host or application system is sent a reset command if the second reset command to the graphics unit 8 is unsuccessful. Such a reset may be a software reset of an operating system and will generally take longer to perform than a reset of the graphics unit 8.

At the end of the process, whether or not either of the checks failed 75 or passed 74, the fault at this stage is likely to be a persistent fault. Therefore, following this, the error counter is increased by one 80 and the process returns 81 to the start, whereupon the process is repeated until such time as the test cycle comes to an end.

The invention attempts to reset the operation of the display module which is relatively quick, in preference to resetting the operation of the graphics system, which is relatively slow, and identifies persistent errors so that rest attempts which are unlikely to be successful are avoided. The invention therefore helps to minimize any inconvenience to the user of the display system from resetting of the display system components.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While various embodiments of the invention have been described, it will be apparent to those of ordinary skill in the art that other embodiments and implementations are possible within the scope of the invention. Accordingly, the invention is not to be restricted except in light of the attached claims and their equivalents.

The invention claimed is:

1. A matrix addressed display system, comprising:

a graphics system for generating display data;

a display module for displaying visual information to a user of the system based on said display data;

a display fault handling system for the detection and correction of display errors by the display module and by the graphics system;

the graphics system having a data output and the display module having a data input, said display data provided by the graphics system to the display module from the data output to the data input, and the display module having a matrix addressed electro-optical array of display elements for displaying said visual information;

the display elements being arranged in rows and columns and having corresponding row and column circuit lines for selectively activating each of said display elements;

the display fault handling system further comprising:

a display error detection means for detection of display errors;

a display error correction means for the correction of said display errors;

the display error correction means being connected by means of a first connection to the display module and being connected by means of a second connection to the graphic system, wherein:

the display error detection means is connected to a plurality of said circuit lines and, in use, is arranged to monitor over a predetermined period of time at least two electrical parameters of each of said connected circuit lines, and to determine therefrom if a display error has occurred at one or more of said activated display elements, the electrical parameters including voltage rise time, voltage fall time, pulse width, pulse timing, and pulse height;

the display error correction means includes a memory and a processing means, the processing means being connected to the display error detection means and, in use, receives and stores error data in said memory relating to said detected display errors over said period of time;

the processing means operatively coupled to the display module and to the graphics system, wherein the display module and the graphics module, respectively, receive a reset command only from the processing means; and the processing means, in use, is responsive to said error data to send at least one reset command over the first connection to reset only the operation of the display module in an initial attempt to correct said detected display errors, and if the initial reset attempt fails, then in response to the failure of the initial reset attempt to send at least one reset command over the second connection to reset only the operation of the graphics system in a subsequent attempt to correct said detected display errors.

2. The matrix addressed display system as claimed in claim 1, in which the display module is powered by at least one power supply and the initial reset command when received by the display module acts to power down and power up the power to the display module from said at least one power supply.

3. The matrix addressed display system as claimed in claim 1, in which the display module comprises a signal processor and the initial reset command when received by the display module acts to reset the signal processor.

4. The matrix addressed display system as claimed in claim 1, in which the display module comprises a timing controller and the initial reset command when received by the display module acts to reset the timing controller.

5. The matrix addressed display system as claimed in any one of the preceding claims, in which the display fault handling system, in use, keeps an error count related to the number of detected display faults and compares said count to an upper limit threshold, the initial reset command only being sent to the display module if said count is below the upper limit threshold.

6. The matrix addressed display system as claimed in any one of claims 1 to 4, in which the display fault handling system, in use, keeps an error count related to the number of detected display faults and compares said count to an upper limit threshold, the subsequent reset command only being sent to the graphics system if said count is below the upper limit threshold.

7. The matrix addressed display system as claimed in any one of claims 1 to 4, in which the graphics system is powered by at least one power supply and the subsequent reset command when received by the graphics system acts to power down and power up the power to the graphics system from said at least one power supply.

8. The matrix addressed display system as claimed in any one of claims 1 to 4, in which the display fault handling system has a data input and the data output of the graphics system is connected to the data input of the display fault handling system, said display data being provided by the graphics system to the display fault handling system, and the display fault handling system being arranged to use said display data together with said at least one electrical parameter in said determination of whether or not a display error has occurred.

9. The matrix addressed display system as claimed in any one of claims 1 to 4, in which the display data includes a display synchronization signal, and the synchronization signal is used by the display fault handling system in the determination of whether or not a display error has occurred.

10. The matrix addressed display system as claimed in any one of claims 1 to 4, in which:

the display data includes a display synchronization signal and the display module includes feedback circuit elements integrated with said display elements, and the synchronization signal is used by the feedback circuit elements to generate a periodic feedback signal synchronized with the display synchronization signal; and the display fault handling system has a data input and the data output of the graphics system is connected to the data input of the display fault handling system, said display data being provided by the graphics system to the display fault handling system, and the display fault handling system being arranged to use the display synchronization signal of said display data together with said at least one electrical parameter in said determination of whether or not a display error has occurred.

11. A motor vehicle, comprising:

a matrix addressed display system, said system being as claimed in any one of claims 1 to 4; and a vehicle power on/off control for activating and deactivating the motor vehicle;

wherein the display fault handling system, in use, is responsive to send said initial reset command or said subsequent reset command only for the first occurrence of a display error following an activation of the motor vehicle.

12. The motor vehicle as claimed in claim 11, in which the display fault handling system, in use, keeps an error count related to the number of detected display faults when the vehicle is activated, said count being retained after the vehicle has been deactivated for use following a subsequent activation of the motor vehicle, wherein display fault handling system, in use, reduces said count towards zero whenever there is no detected display fault between vehicle activation and deactivation.

13. The motor vehicle as claimed in claim 12, in which the display fault handling system, in use, is responsive to send said initial reset command only when the error count is below an upper limit threshold, the initial reset command only being sent to the display module if said count is below the upper limit threshold.

14. The motor vehicle as claimed in claim 12, in which the display fault handling system, in use, is responsive to send said subsequent reset command only when the error count is below an upper limit threshold, the subsequent reset command only being sent to the graphics system if said count is below the upper limit threshold.

15. A method of detecting and correcting display errors of a display module in a matrix addressed display system, the system comprising a graphics system, a display module and a display fault handling system including a memory, the display module having a matrix addressed electro-optical array of display elements, the display elements being arranged in rows and columns and having corresponding row and column circuit lines, the method comprises the steps of:

using the graphics system to generate display data;

sending the display data from the graphic system to the display module;

using the row and column circuit lines to selectively activate each of the display elements and thereby display visual information to a user of the system based on said display data; and using the display fault handling system to:

i) monitor over a predetermined period of time, at least two electrical parameters of a plurality said circuit lines, the electrical parameters including voltage rise time, voltage fall time, pulse width, pulse timing, and pulse height;

ii) determine from said monitored parameter(s) whether or not a display error has occurred at one or more of said activated display elements;

iii) store in the memory error data relating to at least one detected error over a first portion of said period of time;

iv) use said error data stored in the memory in a first decision to send an initial reset command over a first connection to reset only the operation of the display module in a first attempt to correct said detected display errors;

v) store in the memory further error data relating to at least one detected error over a second portion of said period of time subsequent to said first portion; and vi) if said first attempt fails, in response to the failure of the first attempt, use said stored further error data in a second decision to send a subsequent reset command over a second connection to reset only the operation of the graphics system in a second attempt to correct said detected display errors, wherein the display module and the graphics module, respectively, receive the reset command only from the display fault handling system.

16. The method as claimed in claim 15, in which said data relates to a plurality of persistent detected errors in at least one activated display element, and said first decision involves a determination as to whether or not there is a persistent display error and said second decision involves a determination as to whether or not there is a persistent display error.

17. The method as claimed in claim 15 or claim 16, in which data relating to a plurality of detected errors over said first portion of said period of time is used in said first decision.

18. The method as claimed in claim 15 or claim 16, in which data relating to a plurality of detected errors over said second portion of said period of time is used in said second decision.

19. The method as claimed in claim 15 or claim 16, in which the display data includes a display synchronization signal, the display fault handling system receiving from the graphics system the display synchronization signal and using said synchronization signal in the determination of whether or not a display error has occurred.

20. The method as claimed in claim 15 or claim 16, in which the initial reset command when received by the display module acts to power down and power up the display module.

21. The method as claimed in claim 15 or 16, in which the subsequent reset command when received by the display module acts to power down and power up the graphics system.

* * * * *